US006152690A

United States Patent [19]

Tomita et al.

[11] Patent Number: 6,152,690

[45] Date of Patent: Nov. 28, 2000

[54] SEALING APPARATUS FOR GAS TURBINE

[75] Inventors: Yasuoki Tomita; Hiroki Fukuno; Katsunori Tanaka; Toshiaki Sano, all of Hyogo-ken, Japan

[73] Assignee: Mitsubishi Heavy Industries, Ltd., Tokyo, Japan

[21] Appl. No.: 09/242,529

[22] PCT Filed: Jun. 18, 1998

[86] PCT No.: PCT/JP98/02722

§ 371 Date: May 19, 1999

§ 102(e) Date: May 19, 1999

[87] PCT Pub. No.: WO98/58159

PCT Pub. Date: Dec. 23, 1998

[30] Foreign Application Priority Data

Jun. 18, 1997 [JP] Japan ..... 9-161100

[51] Int. Cl.[7] ..... F01D 5/00

[52] U.S. Cl. ..... 415/173.7

[58] Field of Search ..... 415/174.4, 174.5, 415/173.4, 173.5, 115, 116, 173.7

[56] References Cited

U.S. PATENT DOCUMENTS 3,824,030 7/1974 DeFeo ..... 415/173.7
5,217,348 6/1993 Rup, Jr. et al. ..... 415/116

FOREIGN PATENT DOCUMENTS 60-88002 6/1985 Japan .
60-145403 7/1985 Japan .
62-167802 10/1987 Japan .
3-149324 6/1991 Japan .
7-11907 1/1995 Japan .

*Primary Examiner*—Edward K. Look
*Assistant Examiner*—Hermes Rodriguez
*Attorney, Agent, or Firm*—Sughrue, Mion, Zinn Macpeak & Seas, PLLC

[57] ABSTRACT

A seal ring (1) securing inner shroud members (32) of stationary blades (31) is provided with arm portions (2, 3) projecting along lower surfaces of end portions of the inner shroud members (32). Honeycomb seals (4*a*, 4*b*) are mounted on the arm portions (2, 3), respectively. The honeycomb seal (4*a*) is disposed opposite fins (11*a*) provided on a rotor arm portion (11) of a platform (22) of a moving blade (21) so that a predetermined clearance (t) can be maintained between the honeycomb seal and the fins. On the other hand, the honeycomb seal (4*b*) is disposed opposite fins (14*b*) provided on a seal portion (14*a*) of a sealing plate (14) of the moving blade (21) so that a predetermined clearance (t) can be maintained between the honeycomb seal and the fins. The inner shroud members (32) undergo deformation after operation of the gas turbine. However, because the honeycomb seals (4*a*, 4*b*) are mounted on the arm portions (3, 2), respectively, of the seal ring (1) disposed separately and independently from the inner shroud members (32), the honeycomb seals (4*a*, 4*b*) can remain unaffected by the deformation of the inner shroud members (32), whereby the predetermined clearances (t) can be consistently maintained.

7 Claims, 7 Drawing Sheets

SEALING APPARATUS FOR GAS TURBINE

BACKGROUND OF THE INVENTION

1. Technical Field of the Invention

The present invention relates to a sealing apparatus for a gas turbine and more particularly relates to a sealing apparatus for a gas turbine in which clearance variations in a sealing structure intervening between the inner shroud members of stationary blades and the platforms of moving blades are eliminated to improve sealing performance.

2. Description of the Related Art

FIG. 5 is a sectional view showing conventional sealing structure portions in a gas turbine. In the figure, reference numeral 21 denotes a moving blade, 22 denotes a platform thereof, 23 denotes a sealing plate, and numeral 24 denotes a blade root portion. A plurality of moving blades 21 are mounted radially around a rotor by way of the respective root portions 24. Reference numeral 31 denotes a stationary blade disposed adjacent to the moving blade 21, and numeral 32 denotes an inner shroud member of the stationary blade 31. Reference numeral 33 denotes a cavity defined inside of the inner shroud member, and numeral 34 denotes an annular shaped seal ring. Reference numeral 35 denotes an air hole provided in the seal ring 34 through which the cavity 33 and a space intervening between the stationary blade 31 and the blade root portion 24 of the adjacent moving blade 21 are communicated with each other. Reference numeral 36 denotes a sealing portion provided in the seal ring 34, wherein a labyrinth seal or the like is adopted to seal the rotatable root portion 24.

Reference numeral 37 denotes a honeycomb seal mounted on the inner shroud member at the upstream side thereof as viewed in the direction of the combustion gas flow, numeral 38 denotes a honeycomb seal also mounted on the inner shroud member 32 at the downstream side thereof. These honeycomb seals 37 and 38 are disposed in the vicinity of rotor arm portions 25*a* and 25*b* of the platforms 22 of the adjacent moving blades 21, respectively, and provide resistance to air leaks to thereby provide sealing.

This sealing structure will be described in more detail. FIG. 6 shows a portion D in FIG. 5 in detail. The honeycomb seal 38 having a large number of honeycomb cores is disposed at an end portion of the inner shroud member 32 in such a state that the open side of the honeycomb is positioned closely to a tip end portion of the rotor arm portion 25*a* of the platform 22. Moreover, a clearance t between the honeycomb seal 38 and the rotor arm portion 25*a* is substantially 1 mm.

In the above mentioned sealing structure, the air 40 leaking at a high pressure from the cavity 33 (see arrows) flows out into a low-pressure combustion gas passage from a space defined between a side wall of the seal ring 34 provided at the stationary blade 31 and the sealing plate 23 of the moving blade 21 by way of the clearance t formed between the honeycomb seal 38 and the rotor arm portion 25*a* at the downstream side of the combustion gas flow. As the high pressure leaking air 40 flows along the path mentioned above, resistance to its flow increases. Consequently, a sealing effect takes place between the honeycomb seal 38 and the rotor arm portion 25*a* which are disposed close to each other, whereby the high temperature combustion gas is prevented from entering the interior of the stationary blade 31. Similarly, the leaking air flows out into a space between the honeycomb seal 37, provided at the stationary blade 31 and disposed at the upstream side of the combustion gas flow, and the rotor arm portion 25*b*, resulting in increased resistance to the flow of leaking air, whereby sealing is provided for the combustion gas passage.

However, the conventional sealing structure for the gas turbine described above suffers a problem in that since the honeycomb seals 37 and 38 are mounted directly at the end portions of the inner shroud members 32 of the stationary blades 31, nonuniform variation occurs in the clearance t with respect to the circumferential dimension thereof due to deformation of the inner shroud members 32 after operation of the gas turbine, dimensional dispersion of the inner shroud members upon manufacturing or due to other causes. Furthermore, because the rotor arm portions 25*a* and 25*b* of the platform 22 which rotate relative to the inner shroud members 32 are each of an annular shape and follow a circular path upon rotation, the clearances t formed between the honeycomb seals 38 and 37 mounted on the inner shroud members 32 and the rotor arm portions 25*a* and 25*b* of the platform 22 can not be controlled at all, thus giving rise to a problem.

The situation mentioned above will be explained with reference to the drawings. FIG. 7 is a sectional view taken along the line E—E in FIG. 6. Referring to the figure, a plurality of inner shroud members 32 of the stationary blades 31 are mounted independent of one another in an annular array at an appropriate distance along a circumference, and are spaced from the circular rotor arm portion 25*a* by a predetermined distance. Moreover, the honeycomb seal 38 is mounted on the inner shroud member 32, and the space between the honeycomb seal 38 and the rotor arm portion 25*a* represents the clearance t. The state of the inner shroud members 32 immediately after the manufacturing thereof is indicated by solid lines. After operation of the gas turbine, the inner shroud members 32 and the stationary blades 31 undergo deformation due to rotation of the rotor arm portion 25*a*, as indicated by the broken lines. This deformation causes the honeycomb seal 38 to deviate from its desired position, which in turn brings about variation in the clearance between the honeycomb seal 38 and the rotor arm portion 25*a*. Accordingly, control of the clearance between the honeycomb seals 38 mounted on the inner shroud members 32 and the rotor arm portion 25*a* of the platform 22 is made impossible.

OBJECT OF THE INVENTION

In order to solve the problems mentioned above, it is a primary object of the present invention to provide a sealing apparatus for a gas turbine in which the mounting portion for the honeycomb seal is altered so that even when the inner shroud member undergoes deformation after operation of the gas turbine, the clearance between the honeycomb seal and the arm portion of the platform can be protected against variation, to thereby make it possible to control the clearance of the sealing portion.

Further, it is another object of the invention to provide a sealing apparatus of a structure which can further enhance the sealing performance without being effected by the deformation of the inner shroud member such as mentioned above.

SUMMARY OF THE INVENTION

To achieve the objects mentioned above, the present invention provides the following apparatus.

(1) A sealing apparatus for a gas turbine according to the present invention is characterized in that it includes arm portions projecting from a seal ring for fixedly securing inner shroud members of stationary blades, said arm portions extending along front end portions and rear end portions, respectively, of the inner shroud members as viewed in an axial direction thereof, and sealing members mounted on the arm portions, to constitute sealing mechanisms through cooperation with end portions of platforms of moving blades disposed adjacent to the front end portion and the rear end portion, respectively, of the inner shroud member, to thereby seal off the interior of the inner shroud members from a combustion gas passage. Moreover, a honeycomb seal should preferably be employed as the sealing member.

With the arrangement of the present invention described in the above paragraph (1) in which the sealing members are mounted on both arm portions of the seal ring, respectively, the sealing members can be completely protected against the influence of deformation of the inner shroud members even when the individual inner shroud members undergo deformation, accompanied by positional deviation of the inner shroud members, because the arm portions of the seal ring are each an annular shape constructed independent from the inner shroud members. Consequently, the sealing members mounted on the arm portions of the seal ring can not be effected by the deformation of the inner shroud members. Hence the clearances formed between the sealing members and the end portions of the platform of the moving blade can be maintained at a predetermined dimension. Accordingly, a clearance set at an optimal dimension can be maintained even after operation of the gas turbine begins. Thus, clearance control can be significantly enhanced when compared with the conventional sealing structure.

In other words, with the arrangement according to the present invention described in the paragraph (1), the clearance at the sealing portion can be set at an optimal dimensional value because the clearance can be protected against variation.

(2) The sealing apparatus for a gas turbine according to the present invention with the structure set forth in the above paragraph (1) is further characterized in that each of the end portions of the aforementioned platform of the aforementioned moving blade is provided with a projection disposed opposite the aforementioned sealing member.

By virtue of the arrangement according to the present invention mentioned in the above paragraph (2) in which the projection is provided at each end portion of the platform of the moving blade so as to be opposite each sealing member, the setting of the clearance can be facilitated. Further, by providing a large number of fins at each projection, the resistance to the flow of leaking air can be further increased, thus making it possible to decrease the amount of leaking air. Consequently, the performance of the gas turbine can be enhanced.

DETAILED DESCRIPTION OF THE PREFERRED EMBODIMENTS

Figure 1:
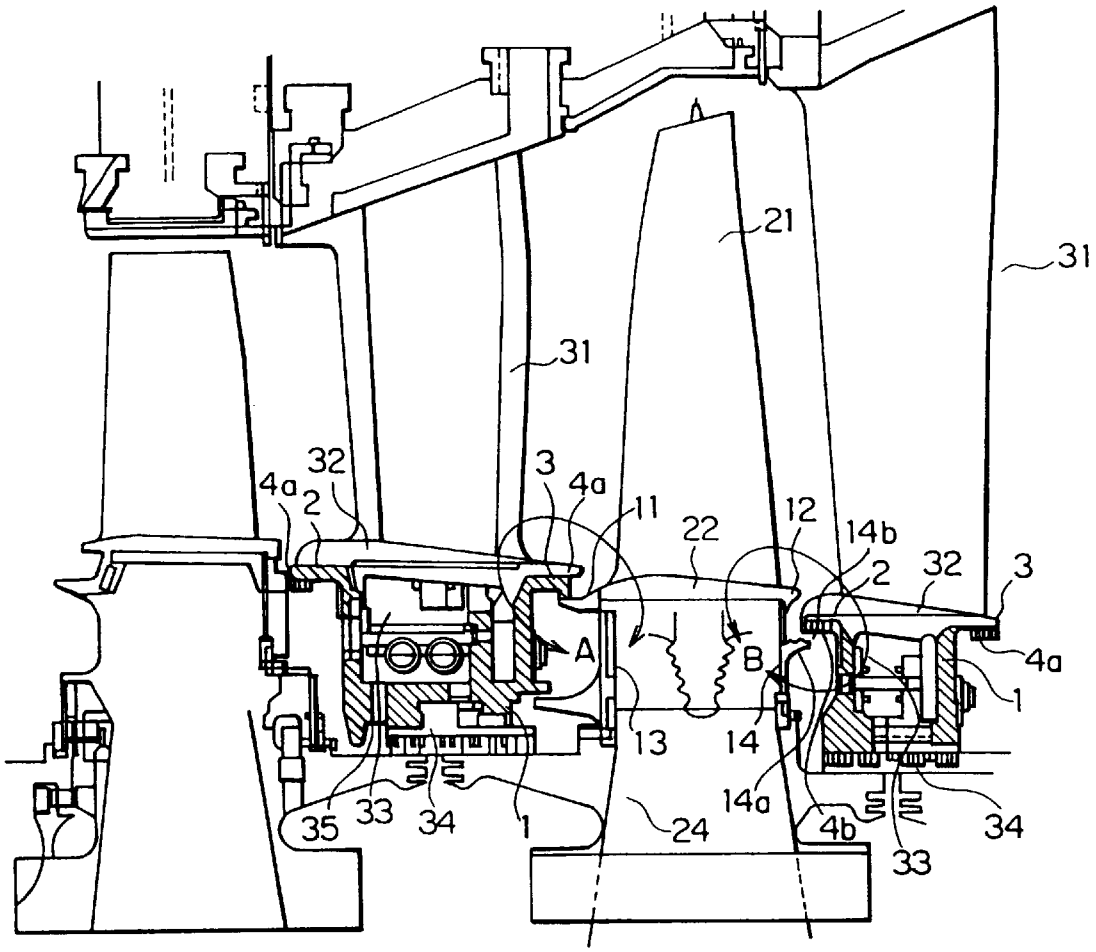
FIG. 1 is a partially sectional schematic view showing a sealing apparatus for a gas turbine according to an embodiment of the present invention, i.e., a mode for carrying out the invention.

The present invention will be described in detail in conjunction with what are presently considered preferred embodiments thereof with reference to the accompanying drawings.

In the following description, like reference numerals designate like or corresponding parts throughout the drawings. Also in the following description, it is to be understood that terms such as "right", "left", "upper", "lower" and the like are words of convenience and are not to be construed as limiting terms.

FIG. 1 is a schematic view showing a sealing apparatus for a gas turbine according to an embodiment of the present invention, i.e., a mode for carrying out the invention. In the figure, reference numeral 21 denotes a moving blade, 22 denotes a platform thereof, and numeral 24 denotes a blade root portion. Reference numerals 11 and 12 denote rotor arm portions disposed, respectively, at the front and rear ends of the platform 22 as viewed in the axial direction, wherein the rotor arm portion 11 disposed on the upstream side of combustion gas flow is disposed at an inner position when compared with that of the conventional turbine, while the rotor arm portion 12 disposed on the downstream side is disposed at an outer position when compared with that of the conventional turbine. Reference numerals 13 and 14 denote sealing plates covering a shank portion, wherein the sealing plate 14 is provided with an integral arm portion 14*a* having fins 14*b*.

Reference numeral 31 denotes a stationary blade, 32 denotes an inner shroud member thereof, 33 denotes a cavity formed inside of the inner shroud member 32, and numeral 34 denotes a sealing portion. A labyrinth seal and the like is adopted a the sealing portion 34, which is disposed close to and opposite the blade root portion 24 of the adjacent rotatable moving blade 21. Reference numeral 35 denotes an air hole through which the cavity 33 and the space around the adjacent moving blade 21 are communicated with each other.

Reference numeral 1 denotes a seal ring of an annular shape which is provided with an arm portion 2 at the upstream side of the combustion gas flow. The arm portion 2 is disposed close to the end portion of the inner shroud member 32 and extends along a curved surface of the end portion, wherein a honeycomb seal 4*b* is mounted on a lower surface of the arm portion 2. Similarly, an arm portion 3 is disposed at the downstream side of the combustion gas flow direction of the seal ring 1. This arm portion 3 is disposed so as to extend along the end portion of the inner shroud member 32, and a honeycomb seal 4*a* serving as the sealing member is mounted on the lower surface of the arm portion 3.

Figure 2:
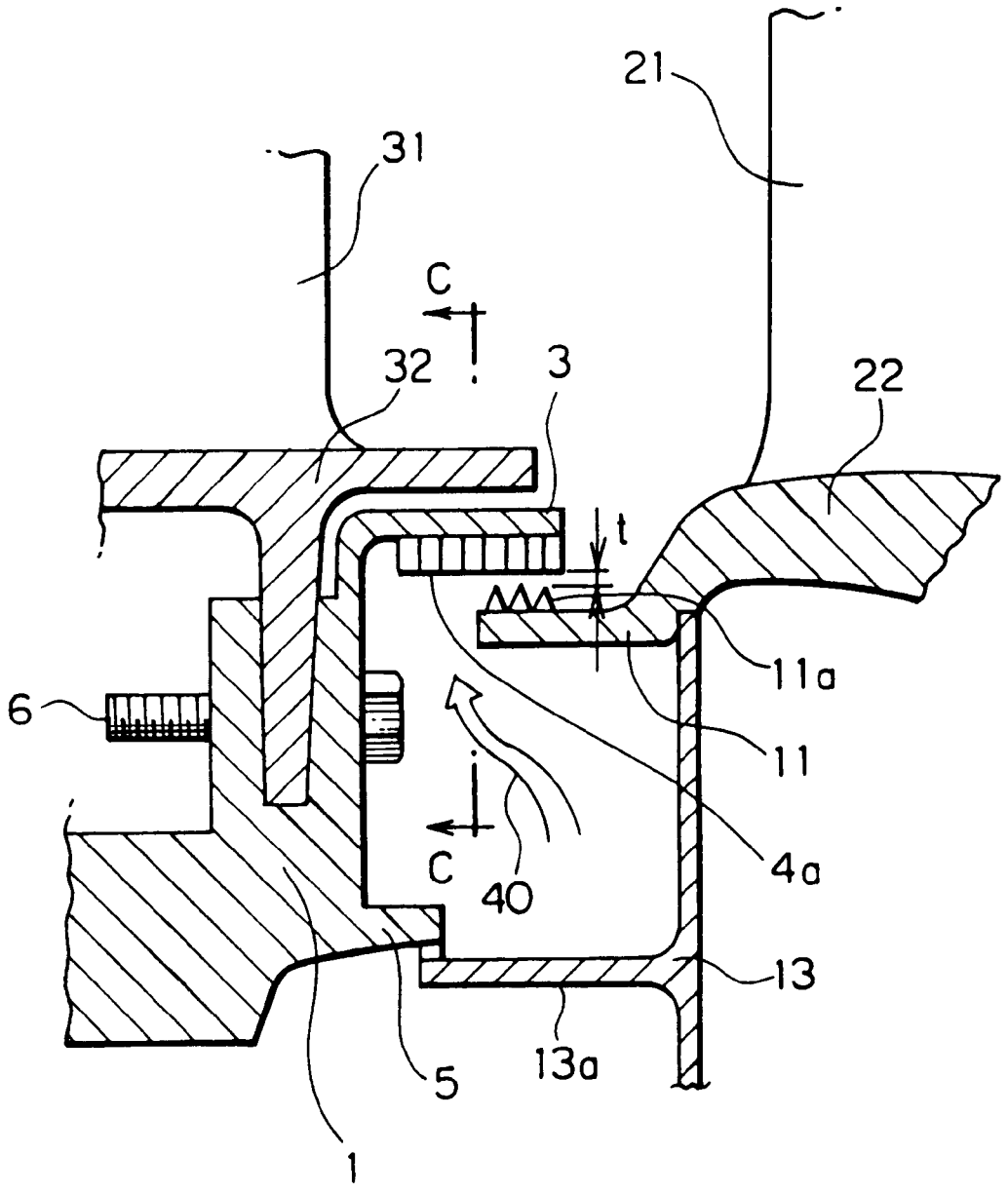
FIG. 2 is an enlarged sectional view of a portion A in FIG. 1 showing details of a sealing structure between a platform of a moving blade and an inner shroud member of a stationary blade on a downstream side of a combustion gas flow.

FIG. 2 is a detailed view of a portion A in FIG. 1 and shows the downstream side of the inner shroud member 32 of the stationary blade 31. Referring to the figure, the seal ring 1 is mounted on the inner shroud members 32. The seal ring 1 is formed in an annular shape and divided into two parts. Each seal ring 1 has the arm portion 3 and a projection 5 at the side adjacent to the moving blade 21 and is fixedly secured to the inner shroud members 32 by means of bolts 6.

The arm portion 3 projects toward the platform 22 and extends along the inner curved surface of the end portion of the inner shroud member 32, and the honeycomb seal 4*a* is mounted on the lower surface of the arm portion. A large number of downward opening honeycomb cores are disposed in the honeycomb seal 4*a*, and the rotor arm portion 11 of the platform 22 of the moving blade 21 is disposed opposite open surface of the honeycomb seal. A large number of fins 11*a* are disposed on the upper surface of the rotor arm portion 11 with a predetermined clearance t, e.g. 1 mm, relative to the honeycomb seal 4*a*. The sealing plate 13 of the moving blade 21 is provided with an arm 13*a* projecting toward the seal ring 1 to form a seal in cooperation with a projection 5 provided in association with the stationary blade 31.

Figure 3:
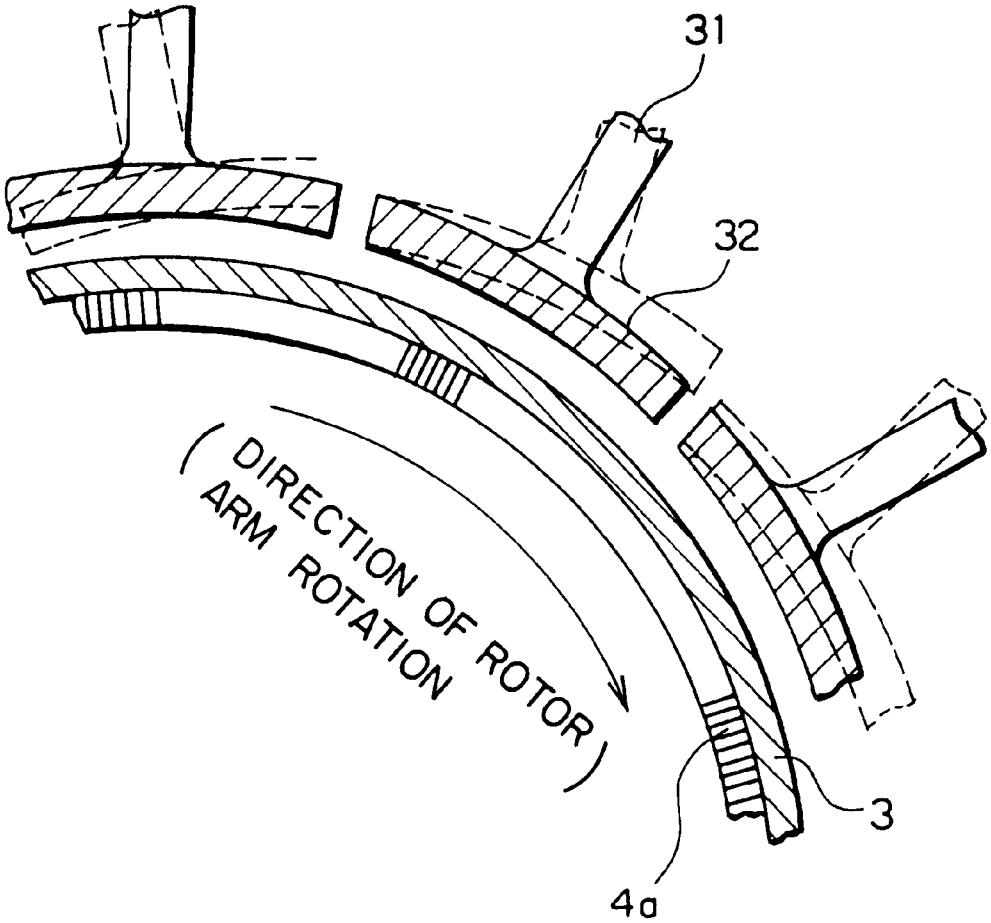
FIG. 3 is a sectional view taken along the line C—C in FIG. 2 showing the relationship between honeycomb seals provided in association with the inner shroud members, respectively, and a rotor arm portion of a sealing plate of a moving blade.

FIG. 3 is a sectional view taken along the line C—C in FIG. 2. As can be seen in the figure, the annular arm portion 3 of the seal ring 1 is disposed at the inner side of a plurality of stationary blades 31 and the inner shrouds thereof which are independently disposed in a circular array, and the circular arm portion 3 is disposed so as to extend along the inner surfaces of the inner shroud members 32. The honeycomb seal 4*a* is mounted on the lower surface of the annular shaped arm portion 3 continuously in an annular form. Moreover, since the honeycomb seal 4*a* is bulky, it is mounted on the arm portion 3 being divided into two parts in the circumferential direction.

In FIG. 3, the inner shroud members 32 in the state before the gas turbine is put into operation are depicted by solid lines. At this time, the inner shroud members 32 are disposed at respective predetermined positions circumferentially. On the other hand, after operation of the gas turbine begins, the inner shroud members are deformed at every stationary blade, as indicated by broken lines. However, since the honeycomb seal 4*a* is mounted on the arm portion 3 of the seal ring 1 which is disposed separately and independently from the inner shroud members 32, as described previously, the honeycomb seal can remain unaffected by the deformation of the inner shroud members 32, and the clearance t between the honeycomb seal 4*a* and the fins 11*a* mounted on the rotor arm portion 11 of the platform 22, as shown in FIG. 2, can be maintained at a predetermined distance.

Figure 4:
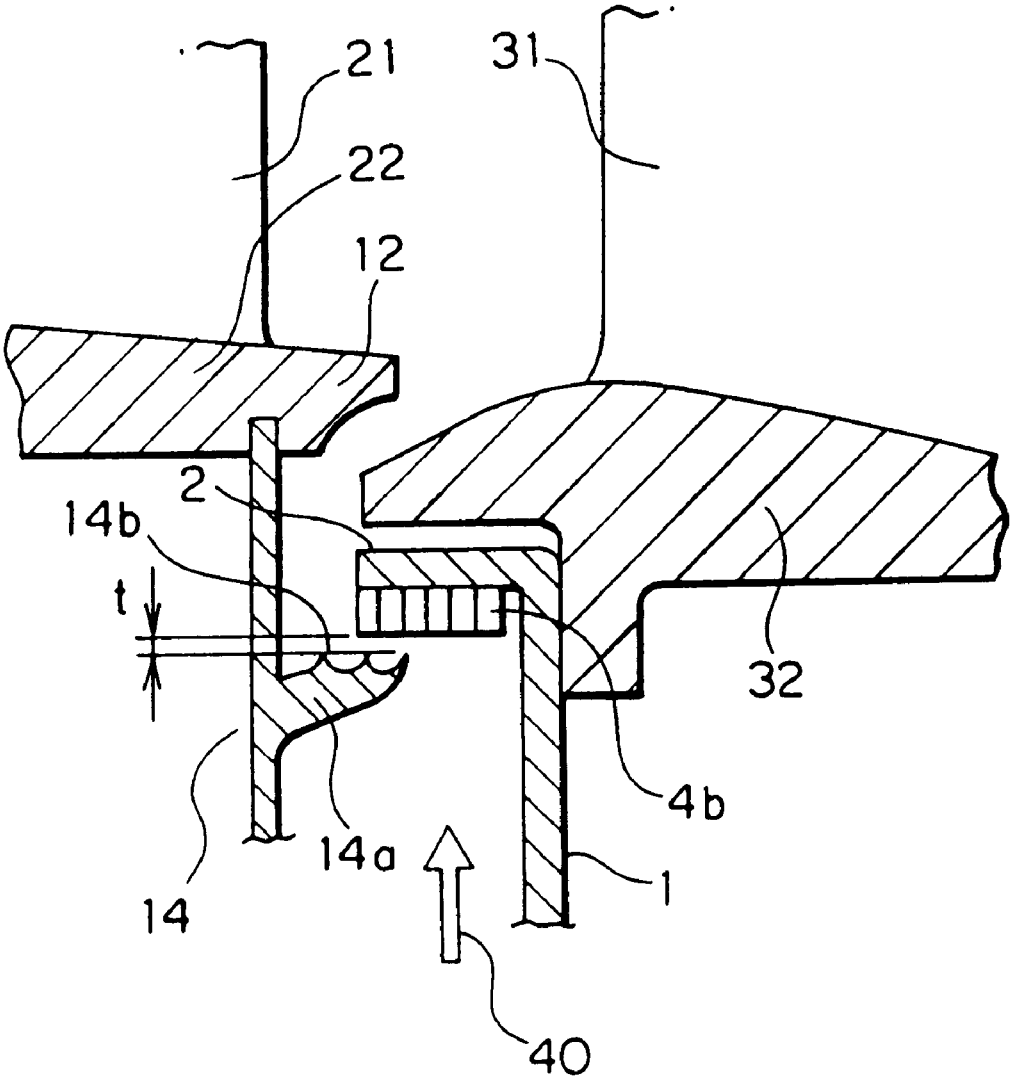
FIG. 4 is an enlarged sectional view of a portion B in FIG. 1 showing, in detail, a sealing structure between the platform of a moving blade and an inner shroud member of a stationary blade on the upstream side of the inner shroud member as viewed in the direction of combustion gas flow.
Figure 5:
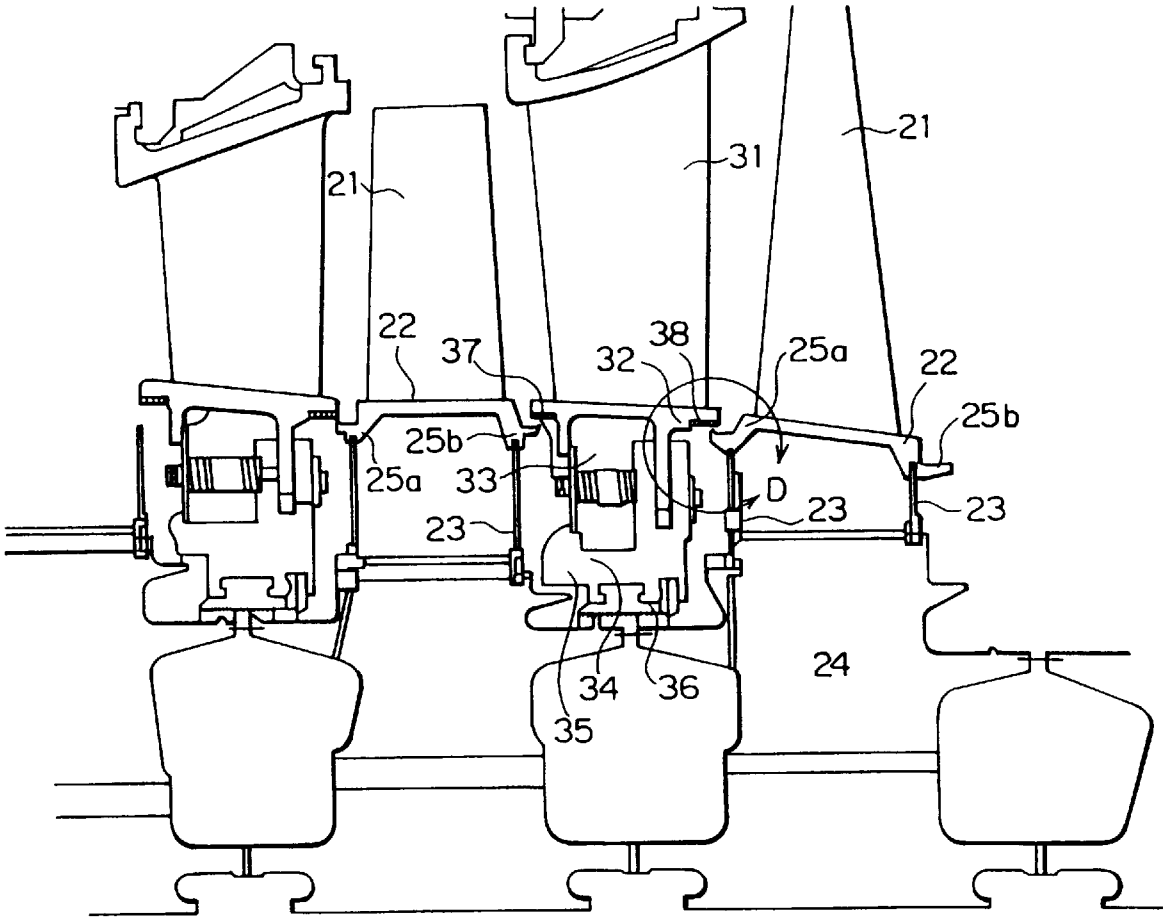
FIG. 5 is a schematic view showing a conventional sealing structure in a gas turbine.
Figure 6:
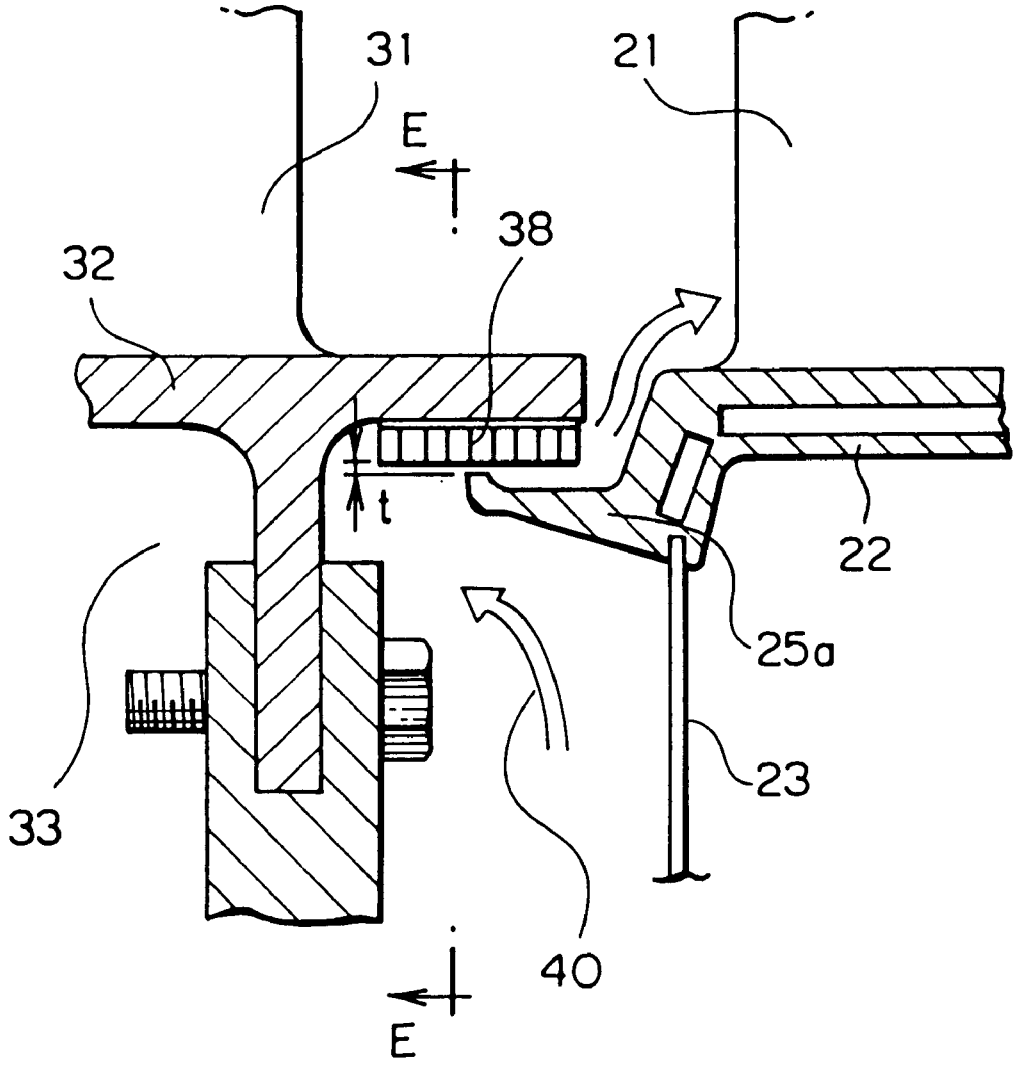
FIG. 6 is an enlarged sectional view of a portion D in FIG. 5 showing, in detail, a sealing structure between the platform of a moving blade and an inner shroud member of a stationary blade on the downstream side of the inner shroud member as viewed in the direction of the combustion gas flow.
Figure 7:
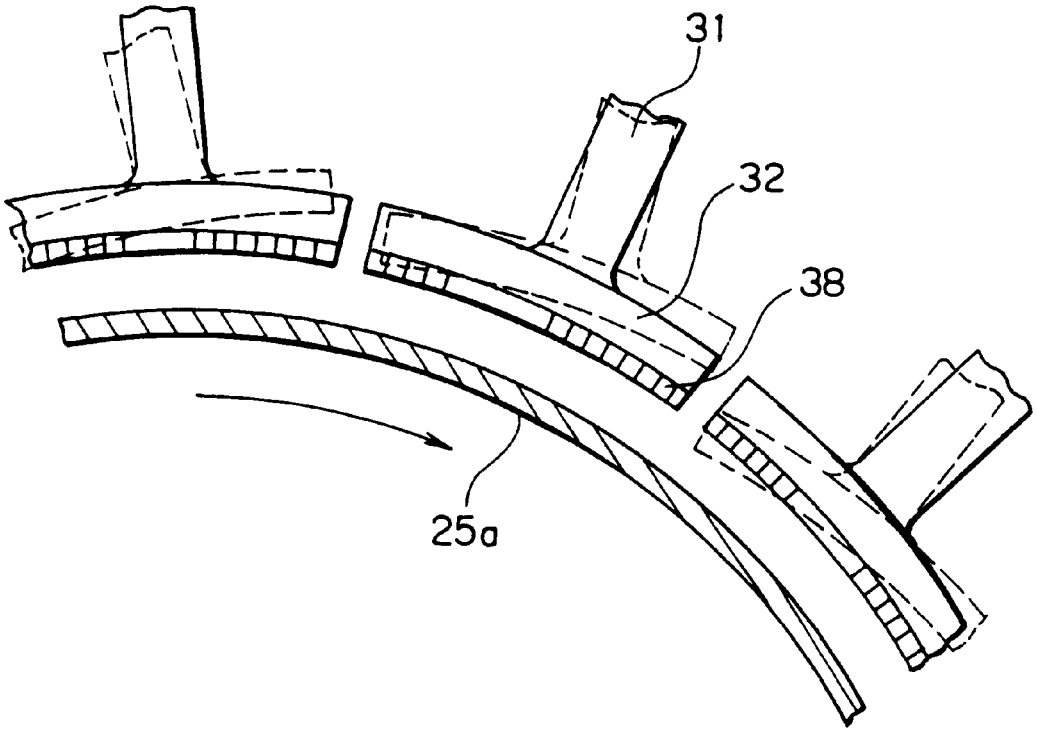
FIG. 7 is a sectional view taken along the line E—E in FIG. 6 showing the relationship between a honeycomb seal provided in association with the inner shroud and a rotor arm portion provided in association with the platform.

FIG. 4 is a detailed view of a portion B in FIG. 1 and shows the inner shroud members 32 of the stationary blade 31 at the upstream side of the combustion gas flow. The seal ring 1 mounted at the inner side of the end portions of the inner shroud members 32 has a projecting arm portion 2 formed by bending the seal ring 1 approximately in an L-like shape along the curved surfaces of the inner shroud members, and the honeycomb seal 4*b* is mounted on the lower surface of the seal ring with the open surface of the honeycomb seal facing downward. On the other hand, the above mentioned sealing plate 14 is mounted on the platform 22 of the moving blade 21, and the sealing portion 14*a* of the sealing plate 14 projects to a position opposite the arm portion 2 which is provided in association with the inner shroud member 32. Fins 14*b* are provided on the sealing portion 14*a* and are disposed opposite the honeycomb seal 4*b* with a predetermined clearance t being maintained relative to the honeycomb seal 4*b*.

Since the honeycomb seal 4*b* is also mounted on the arm portion 2 of the seal ring 1 disposed separately and independently from the inner shroud members 32, as described hereinbefore in conjunction with the relationship between the inner shroud members 32 and the honeycomb seal 4*a* mounted on the arm portion 3 with reference to FIG. 3, the honeycomb seal can remain unaffected by the deformation of the inner shroud members 32. Thereby, the clearance t intervening between the honeycomb seal 4*b* and the fins 14*b* of the sealing plate 14 mounted on the platform 22, as shown in FIG. 4, can be maintained at a predetermined distance.

In the sealing structure described above, the high pressure leaking air 40 flows out from the cavity 33 into the low-pressure combustion gas passage through the space formed between the side wall of the seal ring 1 of the stationary blade 31 and the sealing plate 13 of the moving blade 21 by way of the clearance t formed between the honeycomb seal 4*a* and the fins 11*a* of the rotor arm portion 11 at the downstream side of the inner shroud member 32 of the stationary blade 31 of the gas flow (see FIG. 2). As the high pressure leaking air 40 flows along the path mentioned above, resistance to its flow increases. Consequently, a sealing effect is brought about between the honeycomb seal 4*a* and the fins 11*a* disposed adjacent to each other, whereby the high temperature combustion gas is prevented from entering the interior of the stationary blade 31. Similarly, the leaking air flows out through the space defined between the honeycomb seal 4*b* and the fins 14*b* of the sealing plate 14 at the downstream side of the moving blade 21, whereby sealing is provided for the combustion gas passage due to the increased resistance to the flow of leaking air.

In the sealing apparatus according to the instant embodiment of the invention which operates as described above, the inner shroud members 32 of the stationary blades 31 are deformed at every stationary blade after operation of the gas turbine begins, as indicated by broken lines in FIG. 3. However, since the honeycomb seals 4*a* and 4*b* are mounted on the arm portions 2 and 3 of the annular shaped seal ring 1 which is split into two parts and provided separately and independently from the inner shroud members 32, deformation of the individual inner shroud members 32 or dispersion with respect to the mounting dimensions and the like exert no influence on the honeycomb seals 4*a* and 4*b* of the seal ring 1. Consequently, the sealing clearances t defined between the honeycomb seals 4*a* and 4*b* and the fins 11*a* and 14*b*, respectively, can be maintained at predetermined dimensions.

As is apparent from the foregoing, according to the invention of the instant embodiment, the clearances t which are defined, respectively, between the honeycomb seals 4*a* and 4*b* and the fins 11*a* and 14*b* provided in association with the moving blade 21 and which are set at optimum dimensions upon design for manufacturing and assembling of the gas turbine can be maintained at the predetermined dimensions, notwithstanding deformation of the inner shroud members 32 after operation of the gas turbine begins. In other words, clearance control can be realized. In contrast, when the honeycomb seal is directly mounted on the inner shroud member 32, the clearance mentioned above changes due to the deformation of the inner shroud member 32 after operation of the gas turbine begins. This problem can be solved with the structure according to the instant embodiment of the invention, whereby clearance control for the seal can be remarkably improved.

Furthermore, because the above mentioned clearances are accurately set, the resistance to the flow of leaking air can be further increased by disposing the plurality of projecting fins 11*a* and 14*b* in association with the moving blade 21 opposite the honeycomb seals 4*a* and 4*b*. Since, the amount of leaking air can be decreased, the operating performance of the gas turbine can be enhanced.

Moreover, the arm portion 2 of the seal ring 1 shown in FIG. 4 may be constituted by split members to ensure ease of assembly. Of course, it goes without saying that the seal ring 1 can be formed as an integral structure including the arm portions 2 and 3.

Also, the fins provided in association with the moving blade 21 may be mounted directly on the rotor arm portion 11 which is integral with the platform 22 or, alternatively, mounted on the sealing plate 13 or 14 provided separately and independently from the platform 22.

Furthermore, in the structure according to the instant embodiment of the invention, the arm portions 2 and 3 provided in association with the inner shroud members 32 of the stationary blades 31 are disposed at an outer side, while the sealing portion 14*a* and the rotor arm portion 11*a* provided in association with the moving blades 21 are disposed at an inner side. Accordingly, the honeycomb seals 4*a* and 4*b* provided in association with the stationary blade 31 face inward while the fins 14*b* and 11*a* provided in association with the moving blade 21 face outward, and hence are disposed opposite each other. Consequently, it is equally possible to dispose the arm portions 2 and 3 provided in association with the inner shroud members 32 of the stationary blades 31 at the inner side while each of the sealing portions 14*a* and the rotor arm portion 11*a* provided in association with the moving blades 21 is disposed at an outer side. Accordingly, the honeycomb seals 4*a* and 4*b* provided in association with the stationary blades 31 face outward while the fins 14*b* and 11*a* provided in association with the moving blades 21 face inward, and hence are disposed opposite each other.

In the foregoing, the embodiments of the present invention which are considered preferable at present and other alternative embodiments have been described in detail with reference to the drawings. It should, however, be noted that the present invention is never restricted to these embodiments but other various applications and modifications of the sealing apparatus for the gas turbine can be easily conceived and realized by those skilled in the art without departing from the spirit and scope of the present invention.

What is claimed is:

1. A sealing apparatus for a gas turbine, comprising arm portions projecting from a seal ring, respectively, said seal ring fixedly securing inner shroud members of stationary blades, said arm portions extending along front end portions and rear end portions of said inner shroud members, respectively, as viewed in an axial direction thereof, wherein said seal ring, which is provided with said arm portions, is constructed separately and independently from said inner shroud members, and sealing members mounted on said arm portions, respectively, to constitute sealing mechanisms through cooperation with end portions of platforms of moving blades disposed adjacent to said front end portion and said rear end portion, respectively, of said inner shroud member, wherein said sealing mechanism seals off an interior of said inner shroud members from a combustion gas passage.

2. A sealing apparatus for a gas turbine as set forth in claim 1, wherein said sealing member is a honeycomb seal.

3. A sealing apparatus for a gas turbine as set forth in claim 1, wherein a projection is disposed opposite said sealing member at each of the end portions of said platform of said moving blade.

4. A sealing apparatus for a gas turbine as set forth in claim 1, wherein each of said arm portions disposed in association with said seal ring is formed integrally with said seal ring.

5. A sealing apparatus for a gas turbine as set forth in claim 1, wherein each of said arm portions disposed in association with said seal ring is formed separately and independently from said seal ring.

6. A sealing apparatus for a gas turbine as set forth in claim 1, wherein sealing portions are disposed separately from the end portions of said platform of said adjacent moving blade, and wherein said sealing mechanisms are realized, respectively, through cooperation of said sealing portions and said sealing members mounted on said arm portions, respectively.

7. A sealing apparatus for a gas turbine as set forth in claim 6, wherein each of said sealing portions provided in association with said moving blade is provided with a projection disposed opposite to said sealing member.

* * * * *